US007994999B2

(12) United States Patent
Maeda et al.

(10) Patent No.: US 7,994,999 B2
(45) Date of Patent: Aug. 9, 2011

(54) MICROSTRIP ANTENNA

(75) Inventors: Hiroyuki Maeda, Novi, MI (US); Yingcheng Dai, Novi, MI (US)

(73) Assignee: Harada Industry Of America, Inc., Novi, MI (US)

( * ) Notice: Subject to any disclaimer, the term of this patent is extended or adjusted under 35 U.S.C. 154(b) by 921 days.

(21) Appl. No.: 11/948,628

(22) Filed: Nov. 30, 2007

(65) Prior Publication Data

US 2009/0140927 A1 Jun. 4, 2009

(51) Int. Cl.
*H01Q 13/10* (2006.01)
*H01Q 1/38* (2006.01)
*H01Q 5/00* (2006.01)

(52) U.S. Cl. ..... 343/853; 343/700 MS; 343/855; 343/769

(58) Field of Classification Search ..... 343/700 MS, 343/749, 751, 767, 769, 770, 797, 850, 853, 343/857, 860, 862, 893
See application file for complete search history.

(56) References Cited

U.S. PATENT DOCUMENTS 4,006,481 A * 2/1977 Young et al. ..... 343/770
4,070,676 A 1/1978 Sanford
4,873,529 A 10/1989 Gibson
5,313,216 A 5/1994 Wang et al.
5,444,452 A * 8/1995 Itoh et al. ..... 343/700 MS
5,815,119 A 9/1998 Helms et al.
6,140,968 A * 10/2000 Kawahata et al. ..... 343/700 MS
6,225,959 B1 * 5/2001 Gordon ..... 343/769
6,407,707 B2 6/2002 Nakamura et al.
6,567,048 B2 5/2003 McKinzie, III et al.
6,624,786 B2 9/2003 Boyle
6,861,988 B2 3/2005 Gabriel et al.
6,876,328 B2 4/2005 Adachi et al.
6,891,508 B2 5/2005 Inoue
6,999,038 B2 2/2006 Louzir et al.
(Continued)

FOREIGN PATENT DOCUMENTS

FR 2821503 A1 8/2002

OTHER PUBLICATIONS

Amjad A Omar et al: "Design and Measurement of Self-Matched Dual-Frequency Coplanar Waveguide-Fed-Slot Antennas", IEEE Transactions on Antennas and Propagation, IEEE Service Center, vol. 55, No. 1, Jan. 1, 2007, pp. 223-226.

(Continued)

*Primary Examiner* — Jacob Y Choi
*Assistant Examiner* — Robert Karacsony
(74) *Attorney, Agent, or Firm* — Dickinson Wright PLLC

(57) ABSTRACT

A microstrip antenna that can be linear, co-circular, or dual-circularly polarized having co-planar radiating elements and operating at dual frequency bands wherein an inner radiating element is surrounded by and spaced from an outer radiating element. Each radiating element resonates at a different frequency. In one embodiment of the invention a feed network has a single, cross-shaped, feed line that is positioned between the inner and outer radiating elements and capacitively coupled to the inner and outer radiating elements. In another embodiment of the present invention, the radiating elements are fed separately by first and second feed networks each having a plurality of feed points. The radiating elements each have one active feed point that is either directly or indirectly coupled to its respective feed network.

20 Claims, 4 Drawing Sheets

U.S. PATENT DOCUMENTS

| | | | |
|---|---|---|---|
| 7,019,699 | B2 | 3/2006 | Komatsu et al. |
| 7,161,540 | B1 | 1/2007 | Liu |
| 2006/0103576 | A1 | 5/2006 | Mahmoud et al. |
| 2007/0035450 | A1 | 2/2007 | Chang et al. |
| 2007/0080864 | A1 | 4/2007 | Channabasappa |
| 2007/0126641 | A1 | 6/2007 | Saily |

OTHER PUBLICATIONS

Yu-Juin Ren et al: "Broadband Dual-frequency CPW-fed Annual-ring Antenna", Antennas and Propagation Society International Symposium 2006, Jul. 9, 2006, pp. 3601-3604.

* cited by examiner

MICROSTRIP ANTENNA

TECHNICAL FIELD

The present invention relates generally to a microstrip antenna and more particularly to a microstrip antenna having dual polarization and dual frequency capability.

BACKGROUND OF THE INVENTION

A microstrip antenna is typically comprised of a conductive plate, also known as a patch or a radiating element, that is separated from a ground plane by a dielectric material. The microstrip antenna is fed by applying a voltage difference between a point on the radiating element and a point on the ground conductor. Feed methods include direct feed such as probes or transmission lines and indirect feed such as capacitive coupling.

Microstrip antennas have a low profile, are light weight, are easy to fabricate and therefore, are relatively low cost. These advantages have encouraged the use of microstrip antennas in a wide variety of applications. In the automotive industry in particular, microstrip antennas are used on vehicles for receiving signals transmitted by Global Positioning System (GPS) satellites. Another automotive application includes using a microstrip antenna for a Satellite Digital Audio Radio System (SDARS) receiving antenna. While each of these applications can utilize a microstrip antenna, they each operate at different frequencies and require different polarizations and in the prior art would require separate antennas. As more and more applications are provided on a vehicle that require antennas to be integrated in the vehicle, dual-band and combination antennas provide a viable solution.

Most dual-band microstrip antennas known in the art utilize a stacking technique to obtain dual-band operation. Radiating elements are stacked on top of each other. While this conserves space in a lateral direction, it adds height which detracts from the advantage of the low-profile microstrip antenna. Further, the stacked patches are also subject to decreased performance. The performance of the lowest radiating element is degraded because it is blocked by the radiating element stacked above it. Therefore, the gain and beam width of the antenna may be compromised. An alternative to stacking is a co-planar microstrip antenna. However, interference is a concern with co-planar microstrip antennas. Most co-planar microstrip antennas incorporate slots for obtaining dual-band operation, yet are limited to linear polarization, and have limited bandwidth and gain characteristics. In order to avoid interference problems, co-planar microstrip antennas typically utilize multiple feed points in the feed network.

There is a need for a single microstrip antenna that is capable of operating in more than one frequency band, with more than one possible polarization and without sacrificing the advantages associated with microstrip antenna technology.

SUMMARY OF THE INVENTION

The present invention is a dual-frequency band microstrip antenna that can be linear, co-circular, or dual-circularly polarized. The microstrip antenna has nested inner and outer radiating elements, that are co-planar. The inner radiating element is surrounded, and spaced from the outer radiating element. Each radiating element resonates at a different frequency.

In one embodiment of the invention a feed network has a single, cross-shaped, feed line that is positioned between the inner and outer radiating elements, and a feeding pin passes through the feed line. The cross-shaped feed line is capacitively coupled to the inner and outer radiating elements, which are separated from each other and the feed line by ring slots.

Because of capacitive coupling, the size and shape of the feed line directly affect the impedance and frequency bandwidth of each radiating element. The cross-shaped feed line acts as an impedance transformer between each radiating element and the coaxial cable. When the size and shape of the feed line is altered, its equivalent impedance transformer circuit is altered. As a result, different impedance and frequency bandwidth values will be provided at an antenna input port.

In another embodiment of the present invention, the radiating elements are fed separately by first and second feed networks having a plurality of feed lines. An inner radiating element is connected to a first feed network, while the outer radiating element is connected to a second feed network. The first feed network consists of multiple feed points on the inner radiating element. Only one feed line for the inner radiating element can be selected for a particular antenna application. The outer radiating element is supplied by a second feed network. Only one feed line for the outer radiating element can be selected for a particular antenna application as well. The first and second feed networks may be directly fed, indirectly fed, or a combination thereof.

The indirect feed is a coupling a single feed in multiple feed points in the feed network, each being configured as an island that is spaced from the radiating element by an annular ring. The island is a microstrip patch that is physically connected to a coaxial cable. For the indirect feed, the radiating element is capacitively fed by the island-like feed point. The direct feed is a physical coupling of a single feed in multiple feed points in the feed network. The feed point on the radiating element is physically connected to an RF power source, such as by a probe or a coaxial cable.

In either embodiment, polarization can be linear, co-circular, or dual-circular. The radiating elements having linear polarization can be altered by providing blunt edges on selected corners of the radiating elements to produce a desired circular polarization. Opposite corners and similar corners for the blunt edges will determine whether the polarization is right-hand or left-hand circular for each of the radiating elements.

An advantage of the antenna of the present invention is that a single feed point is all that is required in the cross-shaped feed network while still providing dual-frequency and dual-polarization capability. Another advantage, associated with the multi-feed embodiment, is that there is flexibility in the feed network option. One feed may be physically connected and another feed is capacitively coupled, thereby improving impedance matching and providing a wider bandwidth than a direct feed to the ring patch.

Another advantage, applicable to either feed network, is that the antenna operates at dual frequencies. The radiating elements are co-planar. However, the inner radiating element operates at one frequency while the outer radiating element operates at a different frequency. Yet another advantage is that the antenna can be linearly, co-circularly, or dual-circularly polarized.

The feed network, consisting of a single cross-shaped feed line, excites both horizontal and vertical radiating apertures of the inner and outer radiating elements, thereby providing dual polarization capabilities. The feed network, consisting of multiple feed point locations provides flexibility in selecting the polarization and increases isolation between the radiating elements. The multiple feed point locations can accommodate either center fed or diagonal fed configurations for the microstrip antenna.

Other objects and advantages of the present invention will become apparent upon reading the following detailed description and appended claims, and upon reference to the accompanying drawings.

BRIEF DESCRIPTION OF THE DRAWINGS

For a more complete understanding of this invention, reference should now be had to the embodiments illustrated in greater detail in the accompanying drawings and described below by way of examples of the invention. In the drawings.

DETAILED DESCRIPTION OF THE INVENTION

Figure 1:
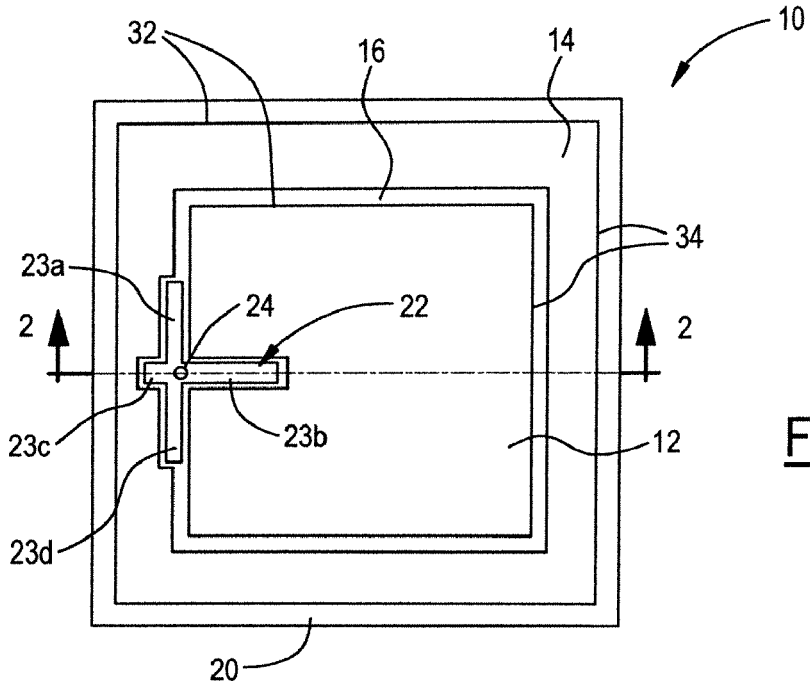
FIG. 1 is a plane view of one embodiment of the microstrip antenna of the present invention having a cross-shaped feed network.
Figure 2:
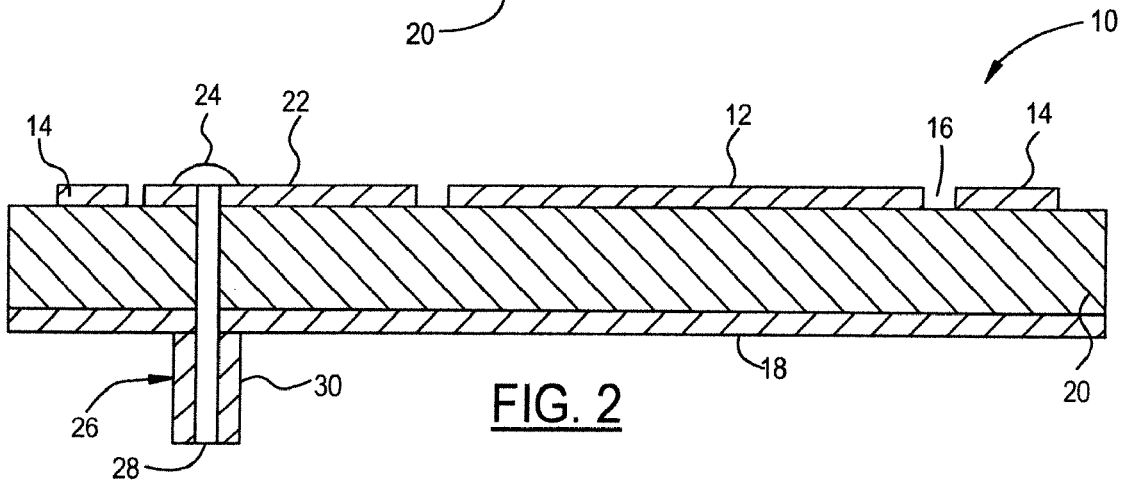
FIG. 2 is a cross-sectional view of the antenna of FIG. 1.

FIG. 1 is a plane view of one embodiment of a microstrip antenna shown generally at 10 and FIG. 2 is a cross-sectional view of the embodiment in FIG. 1 as taken along the line 2-2 in FIG. 1. Hereinafter, like reference numerals in each of the drawings reflect like elements. The antenna 10 has an inner radiating element 12 and an outer radiating element 14, both are microstrip patch elements. The inner radiating element 12 is nested within and co-planar to the outer radiating element 14. A feed network shown generally at 22 feeds inner and outer radiating elements 12, 14 at a single point by a feed pin 24. The inner and outer radiating elements 12 and 14 are separated from each other by a separation 16, which generally mimics the shape of each of the inner and outer radiating elements 12, 14 and the shape of the feed network 22. Referring to FIG. 2, a conductive ground plane 18 is spaced from the inner and outer radiating elements by a dielectric material 20. The dielectric material 20 has a predetermined thickness and dielectric constant that is dependent on the antenna characteristics and design parameters.

FIG. 2 shows the feed network 22 and feed pin 24. The single feed pin 24 is fed power, such as RF power, by a coaxial cable 26 having an inner conductor 28 and an outer conductor 30. The outer conductor 30 is connected to the ground plane 18. In the embodiment shown in FIGS. 1 and 2, the feed network 22 and the radiating elements 12, 14 are not physically connected. There is mutual coupling between the feed network 22, the radiator elements 12, 14 and the ground plane 18 by virtue of their close proximity and by virtue of electromagnetic fields that are set up between the various features 12, 14, 22 and the ground plane 18.

Figure 3:
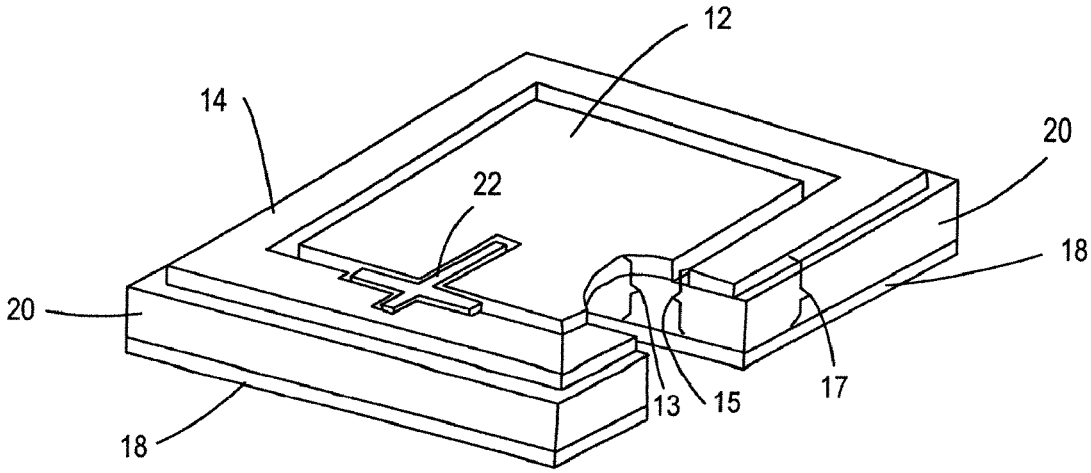
FIG. 3 is a perspective view of the antenna of FIG. 1.

The inner and outer radiating elements 12 and 14 are defined by radiating apertures 13, 15, 17 between a periphery of each radiating element 12, 14 and the underlying ground plane 18 as shown in the perspective view of FIG. 3. The radiating apertures 13, 15, 17 are determined by the overall microstrip antenna size, material thickness of both the radiating elements 12, 14 and the dielectric material, and the gap distance between the radiating elements. For example, the inner radiating element 12 defines a radiating aperture 13, as the space between a top edge of the radiating element 12 and the underlying ground plane 18. Radiating element 14 is defined by the radiating apertures 15 and 17, the space between the edges of the radiating element 14 and the ground plane 18. Aperture 15 is the inside edge of the radiating element 14 and aperture 17 is the outside edge of the radiating element 14. The microstrip antenna size is inversely proportional to the resonate frequency. Therefore, a radiating element having a smaller area will resonate at a higher frequency. The inner radiating element 12, having a smaller overall area, is resonant at a higher frequency than the outer radiating element 14.

As shown in FIG. 1, the inner and outer radiating elements 12, 14 define horizontal radiating apertures 32 and vertical radiating apertures 34. The feed network 22 excites both the horizontal and vertical apertures 32, 34. For the horizontal radiating apertures 32, the resulting radiation will have a polarization that is transverse to the radiating apertures known as vertical linear polarization. Likewise, for the vertical radiating apertures 34, the resulting radiation will have a polarization that is transverse to the radiating apertures, known as horizontal linear polarization.

Figure 4:
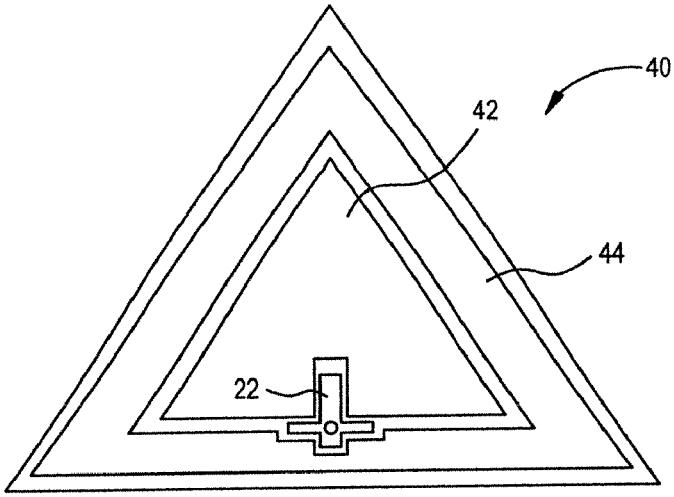
FIG. 4 is a plane view of another embodiment of the microstrip antenna of the present invention.
Figure 5:
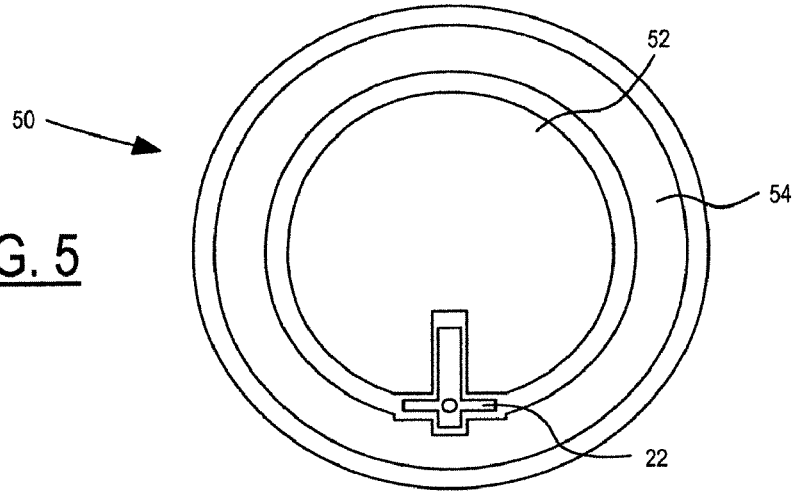
FIG. 5 is a plane view of yet another embodiment of the present invention.

Microstrip antennas can have configurations of many different shapes including, for example a circle, a polygon or a free-form shape. A square configuration with nested square inner and outer radiating elements 12, 14 has been illustrated in FIGS. 1 and 2 for example purposes and simplification of the description. The radiating elements may take on any shape which resonates at a required frequency for a particular element. FIG. 4 is an example of triangular configuration shown at 40 having inner 42 and outer 44 triangular shaped radiating elements. FIG. 5 is an example of a circular configuration shown at 50 having inner 52 and outer 54 circular shaped radiating elements. As explained with reference to FIG. 1, the inner radiating element resonates at a higher frequency than the outer radiating elements and the cross-shaped feed network 22 has a single feed point 24. In FIGS. 4 and 5, the radiating elements are co-planar and separated from the ground plane 18 by a dielectric material 20. While the polarization in the embodiments of FIGS. 1 through 5 is shown as linear, it should be noted that modifications, that will be discussed hereinafter, may be made to the radiating elements in order to achieve circular polarization.

Figure 6:
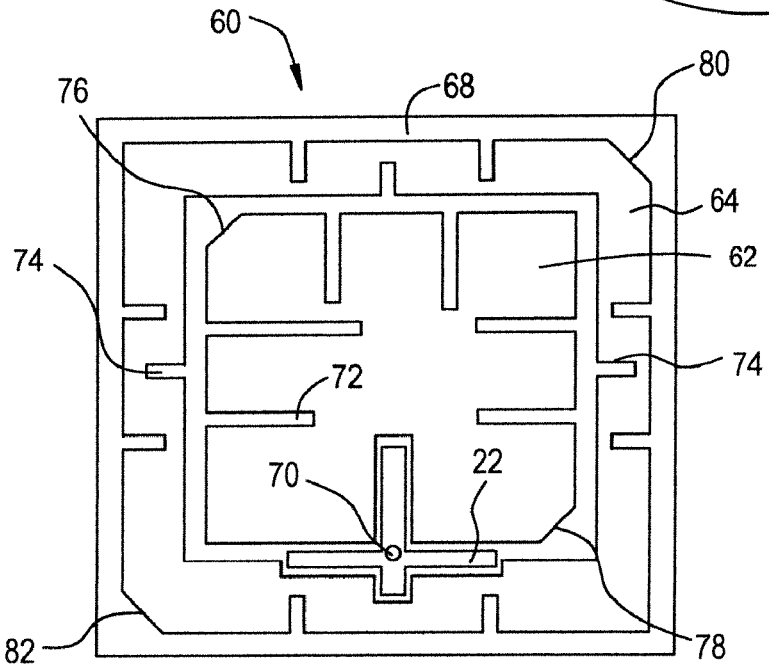
FIG. 6 is a plane view of a dual-frequency dual-circularly polarized embodiment of the antenna of the present invention.

FIG. 6 shows another embodiment of the microstrip antenna shown generally at 60. An inner radiating element 62 is co-planar and nested within an outer radiating element 64 supported by and separated from a ground plane (not shown) by a dielectric material 68. The inner and outer radiating elements 62 and 64 are fed by a single feed point 70. The inner radiating element 62 has a plurality of slits 72 extending inward from its outer perimeter and the outer radiating element 64 has a plurality of slits 74, greater in number than the inner radiating element, extending inward from its inner and outer perimeters. The slits 72, 74 reduce the overall antenna dimensions while tuning each radiating element 62, 64 to an intended operating frequency.

Providing slits in the radiating elements will shift the antenna resonate frequency. More slits will cause a downward shift in the frequency and will make the physical size of the antenna smaller. Each antenna can be adjusted to its intended application, so it should be noted that while six and eleven slits are shown in the embodiment in FIG. 6, it is in no way limiting. Furthermore, slits are shown on both the inner and outer perimeter of the outer radiating element. Yet it is possible that only one of the inner or outer perimeters of the outer radiating element may have slits. One skilled in the art is capable of determining the number of slits, their dimension and their location in order to adjust the antenna frequency to its desired resonate frequency.

While slits reduce the physical size of the antenna, introducing slits on the sides of the microstrip antenna makes the antenna "electrically" bigger, and therefore the radiating element will resonate at a lower frequency. More slits on the antenna causes the currents on the surface of the radiating element to travel around the slits, thereby making the antenna electrically bigger, and shifting the resonate frequency lower.

Unlike the embodiment shown in FIGS. 1-5, the embodiment shown in FIG. 6 is circularly polarized. The inner radiating element 62 operates at a first frequency and is left-hand circularly polarized since the diagonal corners 76, 78 are blunt. The outer radiating element 64 is polarized in a second direction opposite of the inner radiating element 62 and is right-hand circularly polarized since diagonal corners 80, 82 are cut. While the use of diagonal corners is shown as a manner of directing polarization, it would be appreciated that many other ways of direction polarization exist including, for example, modifying opposite corners of both radiating elements.

Referring to FIGS. 1 through 6, the cross-shaped feed network 22 is capacitively coupled to the radiating elements 12, 14 and physically connected to the feed point 24. FIG. 2 in particular shows the inner conductor 28 of the coaxial cable 26 being connected to the feed point 24 and the outer conductor 30 of the coaxial cable being connected to the ground plane 18. The cross-shape has four segments, or arms 23*a*, 23*b*, 23*c*, 23*d*, all interconnected, yet not dependent on each other for dimensional characteristics. Each arm segment, 23 *a* through *d*, can be a different length and the physical adjacent length with the radiating element will determine the coupling capacitance between the feed line and the radiating element. The duality of the cross shape increases the coupling with each radiating elements, especially in the case where each radiating element is operating at a different frequency bandwidth. The coupling capacitance between the feed line and the radiating elements is proportional to the length of each side of the element and a gap distance between the inner and outer radiating elements.

By changing the length, width or both dimensions of each of the four arm segments, 23 *a* through *d*, the physical proportions between the microstrip antenna and the gap distance can be modified as desired. The size and shape of the feed network 22 directly affect the impedance and frequency bandwidth of each patch allowing each radiating element to operate at different frequencies. The feed network 22 is also a microstrip line that is electrically connected to the radiating elements through capacitive coupling. Therefore, altering the size and shape of the feed network 22 is relatively simple and inexpensive, just as it is for the radiating elements 12 and 14.

The capacitive coupling and cross-shaped feed network 22 excites each radiating element 12, 14 by close proximity between the feed network 22 and the microstrip antenna edges. The cross shape of the feed network of the present invention allows each radiating element 12, 14 of the antenna to resonate independently. Therefore, each of the radiating elements 12, 14 are isolated from each other while using only a single feed line that is capacitively coupled to each radiating element by way of the arm segments 23*a*, 23*b*, 23*c*, 23*d*.

In FIGS. 1 through 6, the feed point 24 is shown to be positioned at the point of intersection of the cross-shaped feed network 22. This is for example purposes only. The feed point 24 can be located anywhere in the cross-shaped feed network 22. The location of the feed point 24 will affect the antenna impedance, resonant frequency and isolation between the two radiating elements. Therefore, the feed point 24 will be located where the antenna is tuned. One skilled in the art is capable of determining the feed point location depending on the antenna characteristics and application.

An example application of the embodiment shown in FIG. 6 is in the automotive industry. The antenna embodiment shown in FIG. 6, can be used at frequencies that are typical for both a GPS and SDARS antenna. GPS operates at the GPS L1 band having a center frequency on the order of 1.57542 GHz with right hand circular polarization. The SDARS receiving antenna needs to operate at 2320 MHz to 2332.5 MHz for Sirius satellite radio and 2332.5 MHz-2345 MHz for XM satellite radio, both with left hand circular polarization. The embodiment shown in FIG. 6, the inner radiating element 62 can operate at the SDARS band between 2320 and 2345 MHz with left hand circular polarization. The outer radiating element 64 operates at the GPS L1 band and has right hand circular polarization.

In the embodiments shown in FIGS. 1 through 6 the feed network 22 is capacitively coupled to both of the radiating elements for each configuration shown in the embodiments. The cross-shaped feed network 22 can be likened to an island between the inner and outer radiating elements 12, 14 in that the arm segments 23 a through d are not in physical contact with the radiating elements. However, there are several possible methods of feeding the radiating elements, only one of which is capacitive coupling. The impedance matching and performance of a single radiating element is improved for certain operating conditions by applying a direct feed, or physically connected feed network. Likewise, in certain applications it may be advantageous to utilize multiple feed points, or the need for multiple feed points might be unavoidable. For example, in a microstrip antenna with two radiating elements the elements cannot be directly fed by a single feed line or the elements become essentially one antenna and will resonate at a single fundamental frequency. In the case where two elements need to resonate independently and be isolated from each other, more than one direct feed is necessary.

Figure 7:
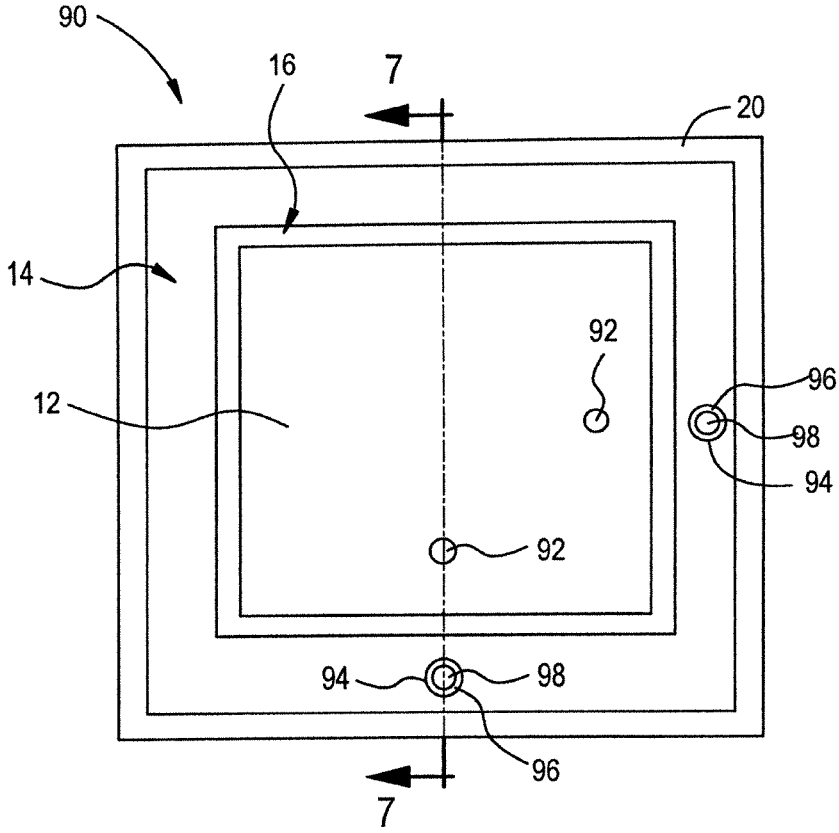
FIG. 7 is a plane view of a dual-frequency, dual polarized embodiment of the antenna of the present invention having multiple feed point locations in the feed network.

FIG. 7 shows another embodiment of the microstrip antenna at 90 in which a feed network having multiple feed point locations is utilized. Elements in FIG. 7 that are similar to elements in FIGS. 1 and 2 have the same reference numbers. The inner and outer radiating elements 12 and 14 are co-planar and spaced from each other by a predetermined distance 16. The dielectric material 20 is supported by the ground plane (not shown in FIG. 7). However, the feed network in the embodiment shown in FIG. 7 is different than the cross-shaped feed network of the embodiments shown in FIGS. 1 through 6. In the embodiment shown in FIG. 7 the feed network has multiple feed point locations 92 on the inner radiating element 12 and multiple feed point locations 94 on the outer radiating element 14. The multiple feed point locations 92 on the inner radiating element may be either directly fed or indirectly fed. Likewise, the multiple feed point locations 94 on the outer radiating element may be either directly fed or indirectly fed.

For example purposes only, the embodiment shown in FIG. 7 shows the inner radiating element 12 having a direct feed and the outer radiating element having an indirect feed. In this embodiment, the two radiating elements 12 and 14 are fed separately. The inner radiating element 12 is physically connected to a probe or a coaxial cable feed point (not shown in FIG. 7). The outer radiating element 14 is fed capacitively through the island-like feed point 94. The capacitive coupling for the outer radiating element 14 provides improved impedance matching and a much wider bandwidth than a direct probe feed to the outer radiating element 14 would provide. As discussed above, a direct feed has high impedance, thereby affecting impedance matching and narrowing bandwidth. Therefore, an indirect feed will provide better impedance matching and a wider bandwidth.

Figure 8:
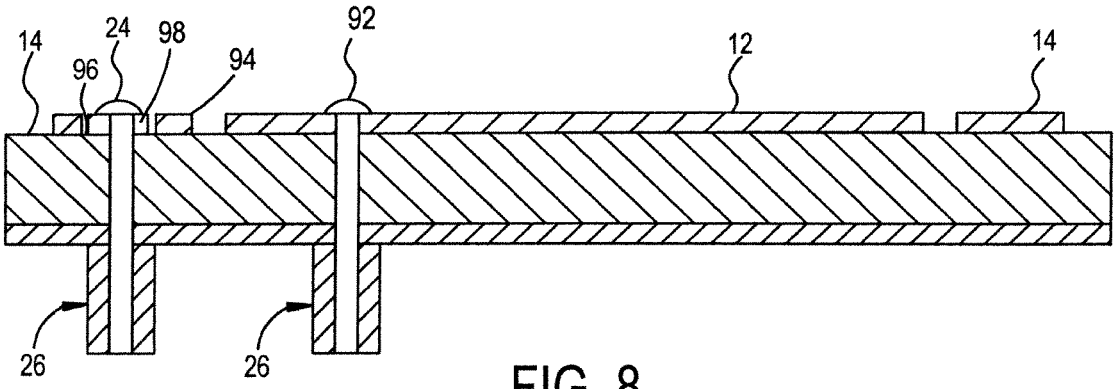
FIG. 8 is a cross-sectional view of the antenna of FIG. 7.

FIG. 8 is a cross-sectional view of the antenna of FIG. 7 taken along line 7-7. The feed point locations on the inner radiating element 12 are physically connected to the patch element 12 by way of a feed pin 24 and a coaxial cable 26. The inner radiating element 12 has a direct feed to each of the feed point locations, yet only one feed point location will be selected and be active at a time. The outer radiating element 14 has a feed pin 24 that is in direct contact with the microstrip island element 98. The radiating element 14 is capacitively coupled to the feed point 24 through annular space 96. The feed pin 24 is fed by an RF source such as the coaxial cable 26 shown.

FIG. 8 shows another configuration of the direct and indirect feed points in which the inner radiating element 12 is indirectly fed by the island feeds 94, 96, 98 and the outer radiating element 14 is directly fed by feed points 92. In the alternative, although not shown, both the inner and outer radiating elements are fed in the same manner, either directly fed or indirectly, yet each radiating element is supplied by its own separate feed. The combination of direct and indirect feeds will depend upon the antenna application. It is known in the art that a direct feed is more robust than an indirect feed. Therefore, in high volume productions, small gap variations in an indirect feed may introduce unwanted issues. On the other hand, direct feeds introduce impedance that can be avoided with an indirect feed. Depending on a particular antenna application, this may or may not be an issue. Therefore, the combination of feed configurations may be dependent upon the antenna use, manufacture and design.

Referring again to FIG. 7, the multiple feed point locations 92, 94 provide flexibility when selecting vertical or horizontal linear polarization for each radiating element. Circular polarization is also possible and will be discussed for this embodiment later herein. The multiple feed point locations increase isolation between the inner and outer radiating elements 12, 14, as only one feed line for each radiating element is selected for each antenna application. The radiating elements 12, 14 may be fed at a vertical side or a horizontal side. While the feed line will be only be provided at one of either the vertical or horizontal sides for each radiating element 12, 14, the presence of either option increases the flexibility of the antenna making it advantageous for use in multiple applications without adding excessive cost to the design and manufacture of the antenna. For increased isolation, each radiating element can be fed from opposite, or different, sides.

The polarization for the embodiment shown in FIG. 7 has been shown and described as vertical and horizontal linear polarization. However, as mentioned above, circular polarization is possible in accordance with the same descriptions herein relative to FIG. 6. Altering two diagonal corners on the radiating elements of the embodiment shown in FIG. 7 to provide blunt edges will create circular polarization and, as discussed in conjunction with FIG. 6, any combination of corners is possible.

Figure 9:
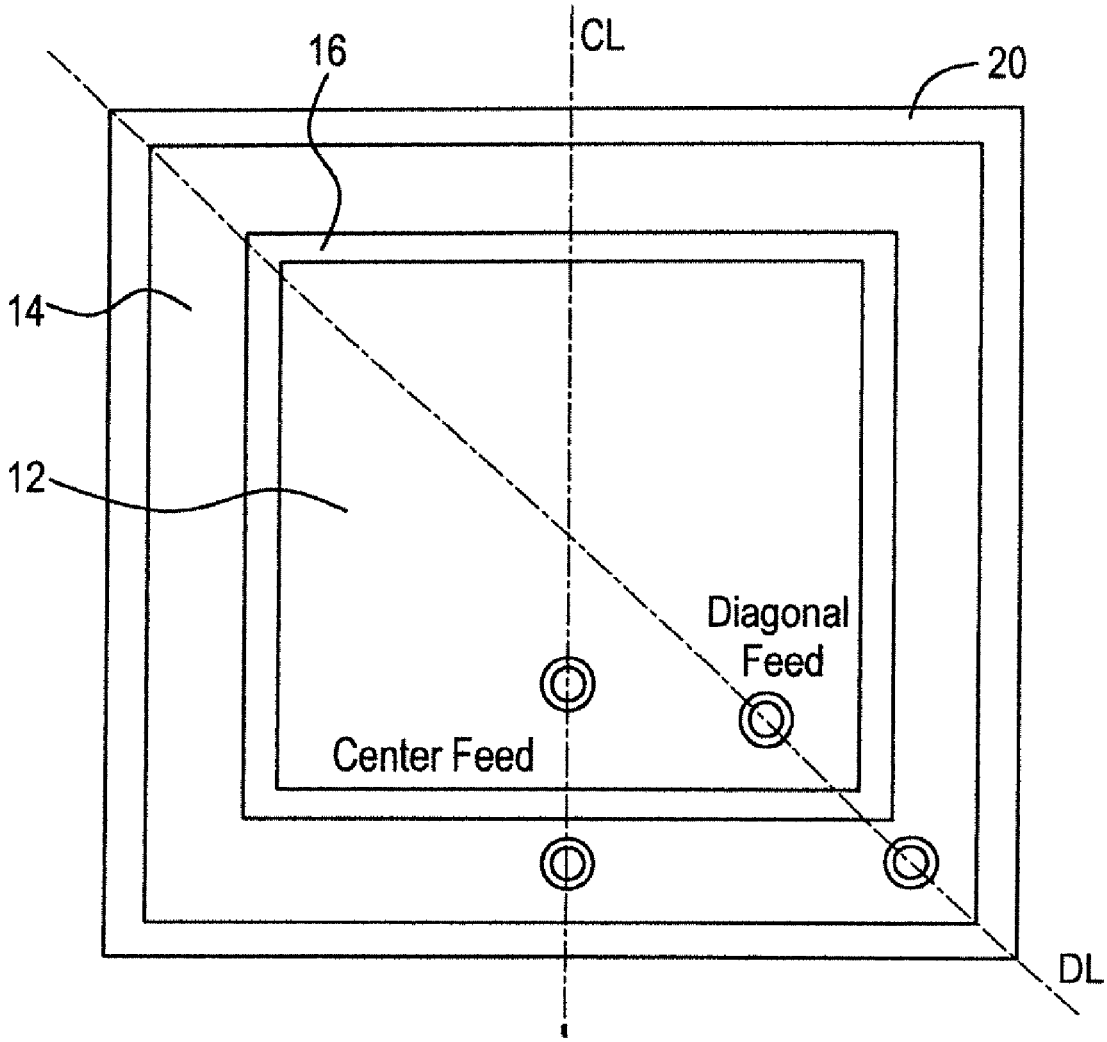
FIG. 9 is a reference drawing generally showing center and diagonal feed positions for a microstrip antenna.

For circular polarization the microstrip antenna can be center fed with blunt edge diagonal corners, or the antenna can be fed diagonally. FIG. 9 shows the difference between feed point locations for a center feed and a diagonal feed. For a center feed network, the feed points are positioned on the symmetric center line CL of the radiating elements 12, 14 and the position for the feed on the center line is determined by the antenna tuning. For a diagonal feed network, the feed points are located on a diagonal line, DL, of the elements 12, 14 whose position is also determined by the antenna tuning.

The invention covers all alternatives, modifications, and equivalents, as may be included within the spirit and scope of the appended claims.

What is claimed is:

1. A microstrip antenna comprising:

a ground plane;

a dielectric material having a predetermined thickness disposed on the ground plane;

an inner radiating element disposed on the dielectric material, the inner radiating element having a predetermined outer perimeter and a first resonating frequency;

an outer radiating element disposed on the dielectric material, co-planar with and at least partially surrounding the inner radiating element, the outer radiating element being spaced from the predetermined outer perimeter of the inner radiating element by a predetermined distance, the outer radiating element having a predetermined inner perimeter, a predetermined outer perimeter and a second resonating frequency different from the first resonating frequency of the inner radiating element;

a first plurality of radiating apertures between a top edge of the predetermined outer perimeter of the inner radiating element and the ground plane;

a second plurality of radiating apertures between a top edge of the predetermined inner and outer perimeters of the outer radiating element and the ground plane;

a cross-shaped microstrip feed network disposed between and coplanar with the inner and outer radiating elements, the cross-shaped microstrip feed network being separated from the inner and outer radiating elements by a predetermined distance, the cross-shaped microstrip feed network being capacitively coupled to the inner and outer radiating elements and having a coupling capacitance between the feed network and the inner and outer radiating elements that is proportional to the predetermined distance between the cross-shaped microstrip feed network and the inner and outer radiating elements.

2. The microstrip antenna as claimed in claim 1 wherein the cross-shaped feed network further comprises four segments, each interconnected and having a predetermined length wherein the length of each of the four segments is directly proportional to the coupling capacitance.

3. The microstrip antenna as claimed in claim 2 further comprising;

a single feed pin located in the cross-shaped feed network; and an RF feed connected to the single feed pin and the ground plane.

4. The microstrip antenna as claimed in claim 1 further comprising:

a first plurality of slits in the predetermined outer perimeter of the inner radiating element; and a second plurality of slits in at least one of the predetermined inner and outer perimeters of the outer radiating element, wherein the first and second plurality of slits tune the microstrip antenna to first and second resonating frequencies.

5. The microstrip antenna as claimed in claim 1 further comprising:

the inner radiating element having a square predetermined perimeter;

a first corner of the square predetermined perimeter of the inner radiating element having a blunt edge; and a second corner of the square predetermined perimeter of the inner radiating element having a blunt edge, the second corner being diagonally opposite the first corner;

wherein the first and second blunt edge corners of the inner radiating element provide a circular polarization for the inner radiating element.

6. The microstrip antenna as claimed in claim 1 further comprising:

the outer radiating element having a square ring predetermined perimeter;

a first outer corner of the square perimeter of the outer radiating element having a blunt edge; and a second outer corner of the square ring perimeter of the outer radiating element having a blunt edge, the second outer corner being diagonally opposite the first outer corner thereby defining a circular polarization for the outer radiating element.

7. The microstrip antenna as claimed in claim 5 further comprising:

the outer radiating element having a square predetermined perimeter;

a first outer corner of the square ring perimeter of the outer radiating element having a blunt edge; and a second outer corner of the square ring perimeter of the outer radiating element having a blunt edge, the second outer corner being diagonally opposite the first outer corner thereby defining a circular polarization for the outer radiating element.

8. The microstrip antenna as claimed in claim 7 further comprising:

the blunt edge of the first corner of the inner radiating element and the blunt edge of the first outer corner of the outer radiating element being in similar corner locations;

the blunt edge of the second corner of the inner radiating element and the blunt edge of the second outer corner of the outer radiating element being in similar corner locations; and wherein the circular polarization of the inner radiating element is in the same direction as the circular polarization of the outer radiating element thereby defining co-circular polarization of the microstrip antenna.

9. The microstrip antenna as claimed in claim 7 further comprising:

the blunt edge of the first corner of the inner radiating element and the blunt edge of the first outer corner of the outer radiating element being in diagonally opposite corner locations relative to each other;

the blunt edge of the second corner of the inner radiating element and the blunt edge of the second outer corner of the outer radiating element are in diagonally opposite corner locations relative to each other; and wherein the circular polarization of the inner radiating element is a direction opposite to the circular polarization of the outer radiating element thereby defining dual-circular polarization of the microstrip antenna.

10. A microstrip antenna comprising:

a ground plane;

a dielectric material having a predetermined thickness disposed on the ground plane;

an inner radiating element disposed on the dielectric material, the inner radiating element having a predetermined outer perimeter, a first resonant frequency and a first polarization;

an outer radiating element disposed on the dielectric material, co-planar with and at least partially surrounding the inner radiating element, the outer radiating element having a predetermined inner perimeter being spaced a predetermined distance from the predetermined outer perimeter of the inner radiating element, a predetermined outer perimeter, a second resonant frequency and a second polarization;

a cross-shaped microstrip feed line disposed between and coplanar with the inner and outer radiating elements, the cross-shaped microstrip feed line being separated from the inner and outer radiating elements by a space having a predetermined size and defining a coupling capacitance between the cross-shaped microstrip feed line and the inner and outer radiating elements.

11. The microstrip antenna as claimed in claim 10 wherein the cross-shaped microstrip feed line further comprises four intersecting segments, each segment having a predetermined length wherein the length of each of the four segments is directly proportional to the coupling capacitance.

12. The microstrip antenna as claimed in claim 11 wherein the cross-shaped microstrip feed line further comprises a single feed pin.

13. The microstrip antenna as claimed in claim 12 wherein the single feed line is fed by a coaxial cable having inner and outer conductors, the inner conductor being connected to the microstrip patch feed line and the outer conductor being connected to the ground plane.

14. The microstrip antenna as claimed in claim 12 wherein the single feed pin is located at a point of intersection of the four intersecting segments.

15. The microstrip antenna as claimed in claim 10 wherein the inner radiating element has a predetermined shape and the outer radiating element has a predetermined shape at least partially surrounding the inner radiating element wherein the predetermined shape of the inner and outer radiating elements are selected from the group consisting of: a circle and a polygon.

16. The microstrip antenna as claimed in claim 10 wherein the first polarization and the second polarization are the same.

17. The microstrip antenna as claimed in claim 16 wherein the first and second polarizations are linear.

18. The microstrip antenna as claimed in claim 16 wherein the first and second polarizations are circular.

19. The microstrip antenna as claimed in claim 18 wherein the first polarization is a circular polarization in a first direction and the second polarization is a circular polarization in a second direction that is opposite the first direction.

20. The microstrip antenna as claimed in claim 10 wherein the first polarization is a linear polarization and the second polarization is a linear polarization perpendicular to the first polarization.

* * * * *